US007145138B1

(12) United States Patent
Thakur

(10) Patent No.: US 7,145,138 B1
(45) Date of Patent: Dec. 5, 2006

(54) EXHAUST PORT DESIGN FOR API SOURCES

(75) Inventor: Rohan A. Thakur, Los Altos, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 11/143,193

(22) Filed: Jun. 1, 2005

(51) Int. Cl.
*H01J 49/00* (2006.01)

(52) U.S. Cl. ..... 250/288; 250/282; 250/423 R; 250/424; 250/425

(58) Field of Classification Search ..... None
See application file for complete search history.

(56) References Cited

U.S. PATENT DOCUMENTS 6,573,494 B1 * 6/2003 Andrien et al. ..... 250/288
6,759,650 B1 * 7/2004 Covey et al. ..... 250/288
2005/0258358 A1 * 11/2005 Thakur ..... 250/288

* cited by examiner

*Primary Examiner*—Jack Berman
*Assistant Examiner*—Zia R. Hashmi
(74) *Attorney, Agent, or Firm*—Carr & Ferrell LLP; Charles B. Katz

(57) ABSTRACT

An atmospheric pressure ionization source is provided. The atmospheric pressure ionization source comprises a chamber housing, a spray probe that produces a spray cone along a spray axis within the chamber, and an exhaust port opposite the spray probe on the housing. The exhaust port includes at least two segments, a first segment of the exhaust port is disposed between a second segment and an opening through the housing that receives the spray cone. The first segment defines a first axis that is co-axial with the spray axis, and the second segment defines a second axis that is angled relative to the first axis.

7 Claims, 5 Drawing Sheets

EXHAUST PORT DESIGN FOR API SOURCES

BACKGROUND OF THE INVENTION

1. Field of the Invention

The present invention relates generally to the field of analytical equipment and more particularly to an apparatus for ionizing analytes for introduction into mass spectroscopy and similar analytical devices.

2. Description of the Prior Art

Various analytical equipment separate analytes, and often their fractional components, according to a mass to charge ratio. Towards that end, the analyte is typically carried by a solvent into an ionizing chamber at the front end of the analytical unit. The analyte is ionized in the ionizing chamber and then the ions are accelerated by an electric field into the analytical unit for analysis. One type of ionizing chamber operates at or near atmospheric pressure and is therefore termed an Atmospheric Pressure Ionization (API) source.

FIG. 1 schematically illustrates a mass spectrometer 100 of the prior art. The mass spectrometer 100 includes an API source 110, a first ion guide 120, a second ion guide 130, and a mass analyzer 140. Ions produced in the API source 110 are directed by the ion guides 120 and 130 into the mass analyzer 140. The API source 110 includes a housing 150 that defines a chamber 160, a spray probe 170, and an exhaust port 180. The API source 110 also includes an ionizing mechanism (not shown).

In operation, a mixture of a solvent and an analyte for analysis is introduced as a fine droplet spray into the chamber 160 by the spray probe 170. Ideally, some of the analyte is ionized by the ionizing mechanism and drawn out of the chamber 160 by the first ion guide 120 while the remainder of the spray exits the chamber 160 through the exhaust port 180. In practice, however, various factors cause mixing between the spray and the atmosphere within the chamber 160. Accordingly, some of the analyte ends up circulating within the chamber 160 and deposits on the internal surfaces thereof.

The effect is two-fold. First, analyte circulating within the chamber 160 creates a memory effect whereby the intensity of the analyte that is read by the mass analyzer 140 will decay over a period of time after the introduction of the solvent/analyte mixture into the chamber 160 has ceased. Accordingly, if a second analyte is introduced too soon after the first, the first analyte will still appear in the reading. Secondly, analytes that deposit on interior surfaces of the chamber 160 slowly re-enter the chamber atmosphere and contribute to a background that reduces the signal to noise ratio.

U.S. Pat. No. 6,759,650 issued to Covey et al. attempts to address this problem through the use of an inner exhaust tube that extends from the exhaust port into the chamber. The leading edge of the inner exhaust tube is disposed close to the ion exit orifice that leads into the first ion guide. Disadvantageously, analytes that happen to collect on the leading edge of the inner exhaust tube can contaminate the atmosphere of the chamber. The concentrations of the contaminants are, of course, highest near the leading edge of the inner exhaust tube which is close to the ion exit orifice. Accordingly, this quickly leads to a reduction of the signal to noise ratio.

Therefore, what is needed is an API source with decreased recirculation of droplets.

SUMMARY

The present invention provides an atmospheric pressure ionization source, as well as a mass spectroscopy system including the same. The atmospheric pressure ionization source comprises a housing defining a chamber, a spray probe configured to produce a spray cone along a spray axis within the chamber, and an exhaust port disposed opposite to the spray probe on the housing. The exhaust port includes at least two segments. A first segment of the exhaust port is disposed between a second segment and an opening through the housing that receives the spray cone. The opening, in some embodiments, is at least as wide as a width of the spray cone at the opening. The first segment defines a first axis that is co-axial with the spray axis, and the second segment defines a second axis that is angled with respect to the first axis. In some embodiments the second axis is angled with respect to the first axis by an angle in the range of about 60° to 90°.

The atmospheric pressure ionization source of the present invention can also comprise an ion exit orifice that defines an axis. In some of these embodiments the spray axis defines an angle of less than 90° relative to the axis defined by the ion exit orifice. The exhaust port of the present invention can further include a deflecting surface that extends from the first segment to the second segment. In some embodiments the deflecting surface is curved. The exhaust port of the present invention can further include a diameter reduction to create a venturi effect therein.

DETAILED DESCRIPTION OF THE INVENTION

The present invention provides Atmospheric Pressure Ionization (API) sources that minimize recirculation of droplets, solvent, and background gas. The APIs of the present invention comprise a chamber for ionizing samples for mass spectroscopy and similar analytical equipment. A spray probe on one side of the chamber directs a spray of a solvent and a sample as a cone of droplets that pass proximate to an ion exit orifice. Ions from the spray cone are extracted through the ion exit orifice. An exhaust port is disposed opposite the spray probe and aligned therewith to collect the spray cone. The design of the exhaust port, as described below, minimizes recirculation within the chamber to reduce the memory effect and to preserve the signal to noise ratio.

Figure 1:
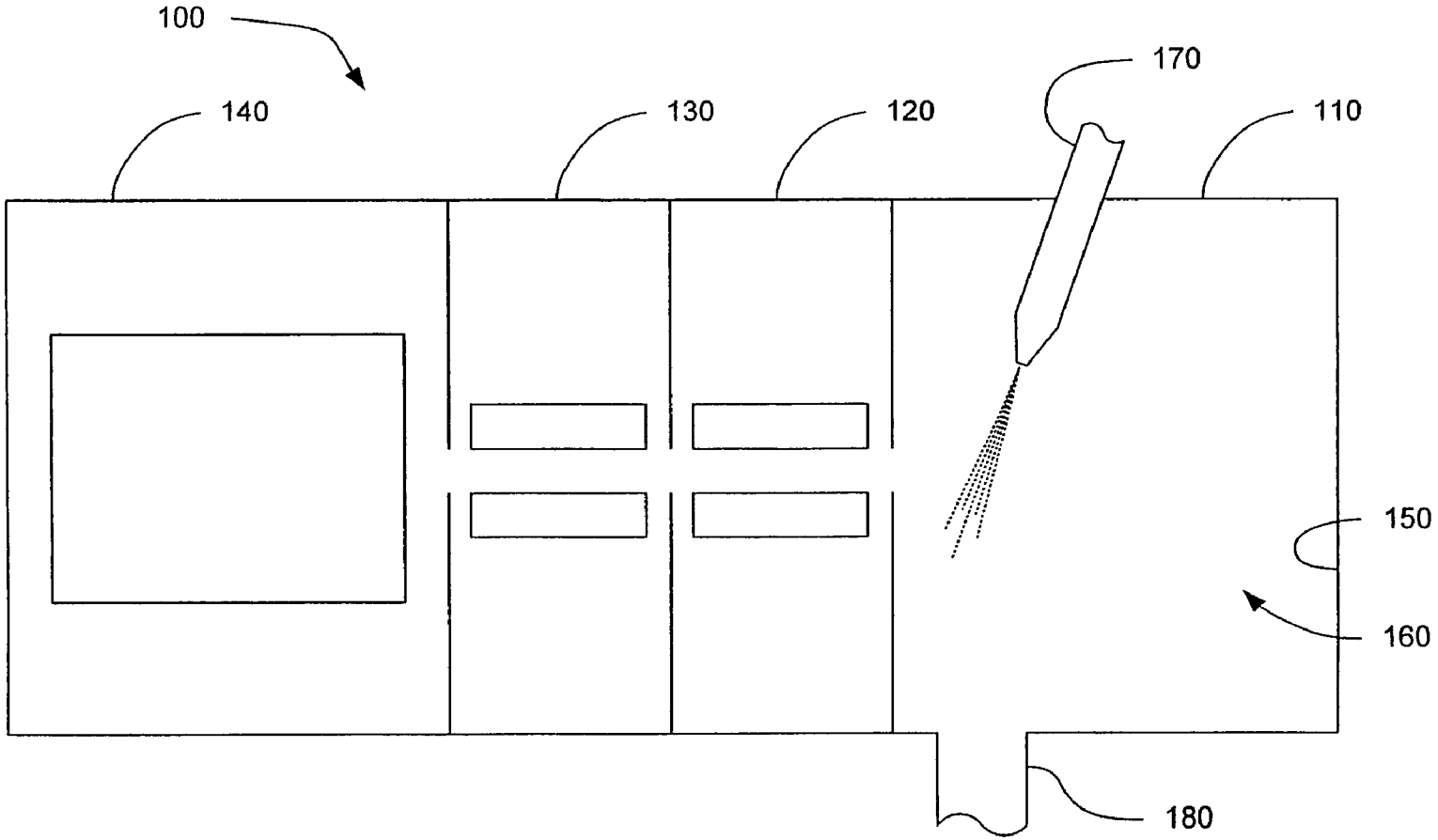
FIG. 1 (Prior Art)
FIG. 1 is a schematic illustration of a mass spectrometer according to the prior art.
Figure 2:
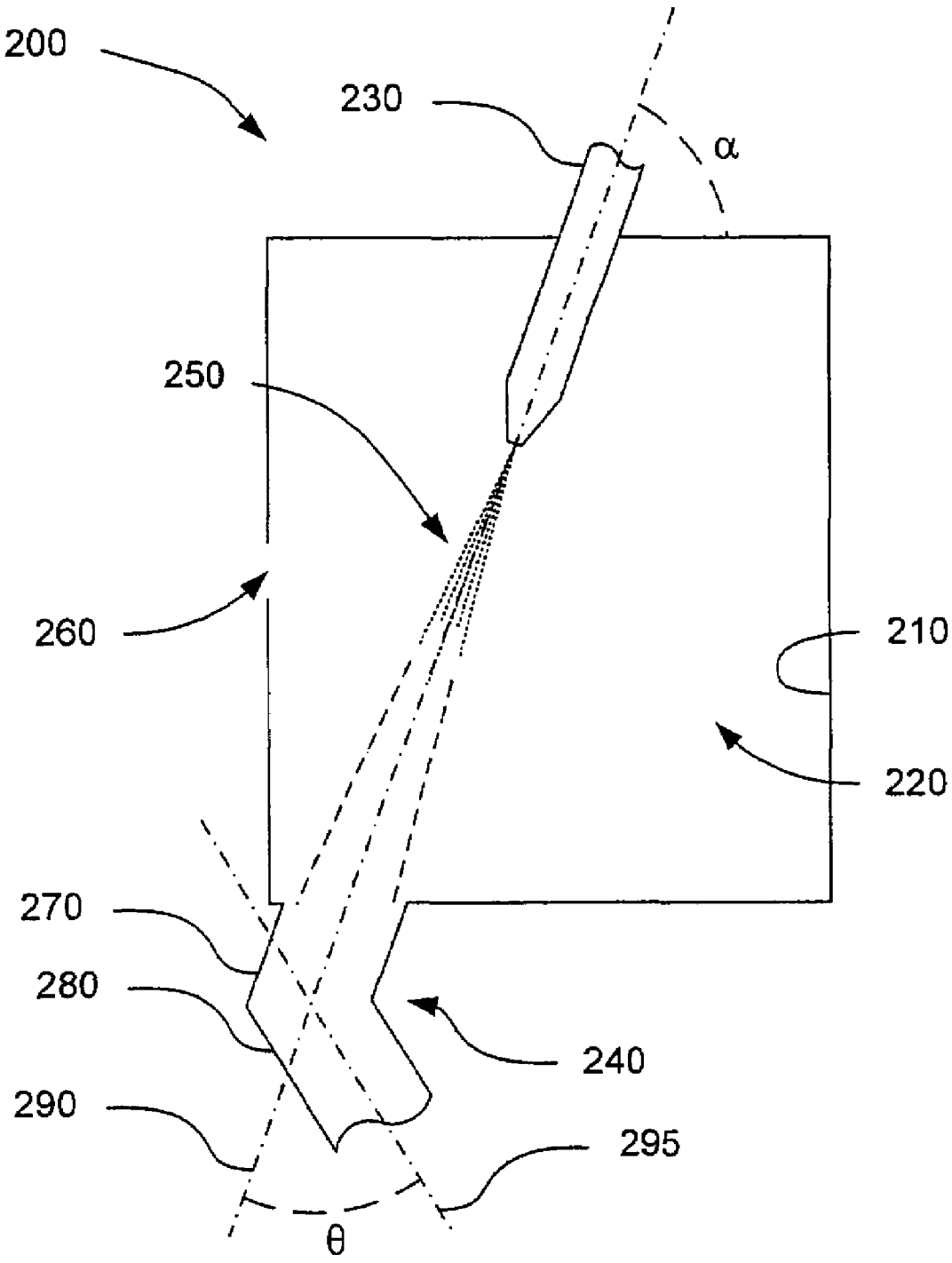
FIG. 2 is a schematic illustration of an atmospheric pressure ionization source according to an embodiment of the present invention.

FIG. 2 schematically illustrates an atmospheric pressure ionization source 200 according to an embodiment of the present invention. The API source 200 includes a housing 210 that defines a chamber 220, a spray probe 230, and an exhaust port 240. The droplet spray probe 230 includes, for example, a capillary that terminates in a spray orifice for producing a fine droplet spray cone 250 of a solvent/analyte mixture. The API source 200 also includes an ionizing mechanism (not shown) for ionizing the analyte from the droplet spray. Examples of suitable ionizing mechanisms include electrospray and Atmospheric Pressure Chemical Ionization (APCI).

The spray probe 230 penetrates the housing 210 at an angle, α. In some embodiments the angle, α, is 90°, while in other embodiments the angle is less than 90°. It will be appreciated that although the angle, α, is shown relative to a surface of the housing 210, the angle, α, is defined relative to an axis (not shown) defined by an ion exit orifice 260 of the housing 210. In the embodiment illustrated by FIG. 2, the axis defined by the ion exit orifice 260 happens to be parallel to the surface of the housing 210.

In operation, some of the ionized analyte is drawn out of the chamber 220 for analysis through the ion exit orifice 260, for example, by an ion gun guide (not shown). The ionized analyte can then by analyzed, for instance, by a mass analyzer of a mass spectrometer (not shown). The remainder of the droplet spray cone 250 is drawn from the chamber 220 through the exhaust port 240 by a vacuum pump (not shown). The exhaust port 240 includes several features designed to prevent the droplet spray cone 250 from being reintroduced into the chamber 220, as discussed in more detail, below.

The exhaust port 240 is situated on the housing 210 such that it is disposed opposite to the spray probe 230. The exhaust port 240 comprises at least two segments, a first segment 270 and a second segment 280. The first segment 270 defines a first axis 290 that is co-axial with a spray axis of the spray probe 230. Likewise, the second segment 280 defines a second axis 295. In some embodiments, an angle, θ, defined between the first and second axes 290 and 295 is in the range of about 60° to 90°. The exhaust port 240 is preferably formed from a highly corrosion resistant material and is provided with a very smooth interior surface finish. Accordingly, electropolished stainless steel is a suitable choice for the exhaust port 240. Coatings or platings can also be applied to achieve corrosion resistance and a very smooth interior surface finish.

Figure 3:
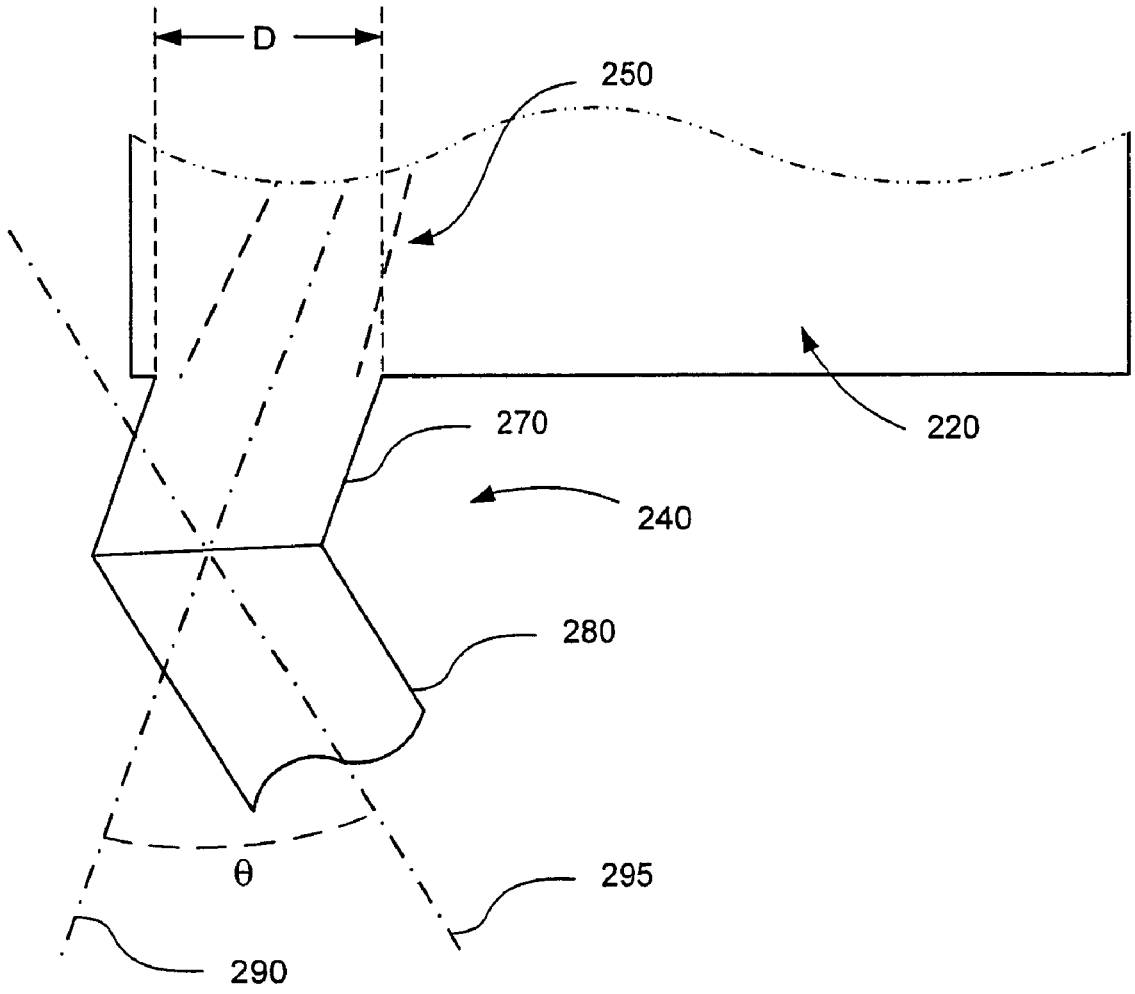
FIG. 3 is an enlarged view of an exhaust port of the atmospheric pressure ionization source of FIG. 2.

FIG. 3 shows an enlarged view of the exhaust port 240. The first segment 270 opens into the chamber 220 through an opening with a diameter, D, that is at least as wide, and preferably wider, than a width of the droplet spray cone 250 at the opening of the exhaust port 240. Having the first axis 290 co-axial with the spray axis, and having the opening diameter, D, at least as wide as the width of the droplet spray cone 250 at the opening, ensures that essentially the entire droplet spray cone 250 is captured within the first segment 270. Additionally, having the first axis 290 co-axial with the spray axis helps direct droplets that strike the interior wall of the first segment 270 further down into the exhaust port 240 rather than back into the chamber 220.

However, turbulence and collisions between droplets can cause some droplets to persist near the opening within the first segment 270. The second segment 280, being angled with respect to the first segment 270, is effective to help remove droplets from the vicinity of the opening of the first segment 270. Once droplets have passed the bend between the first and second segments 270 and 280, the droplets are unlikely to re-enter the first segment 270 to participate in such collisions. The angle, θ, between the first and second axes 290 and 295 can be optimized to improve the removal of droplets from the first segment 270.

Figure 4:
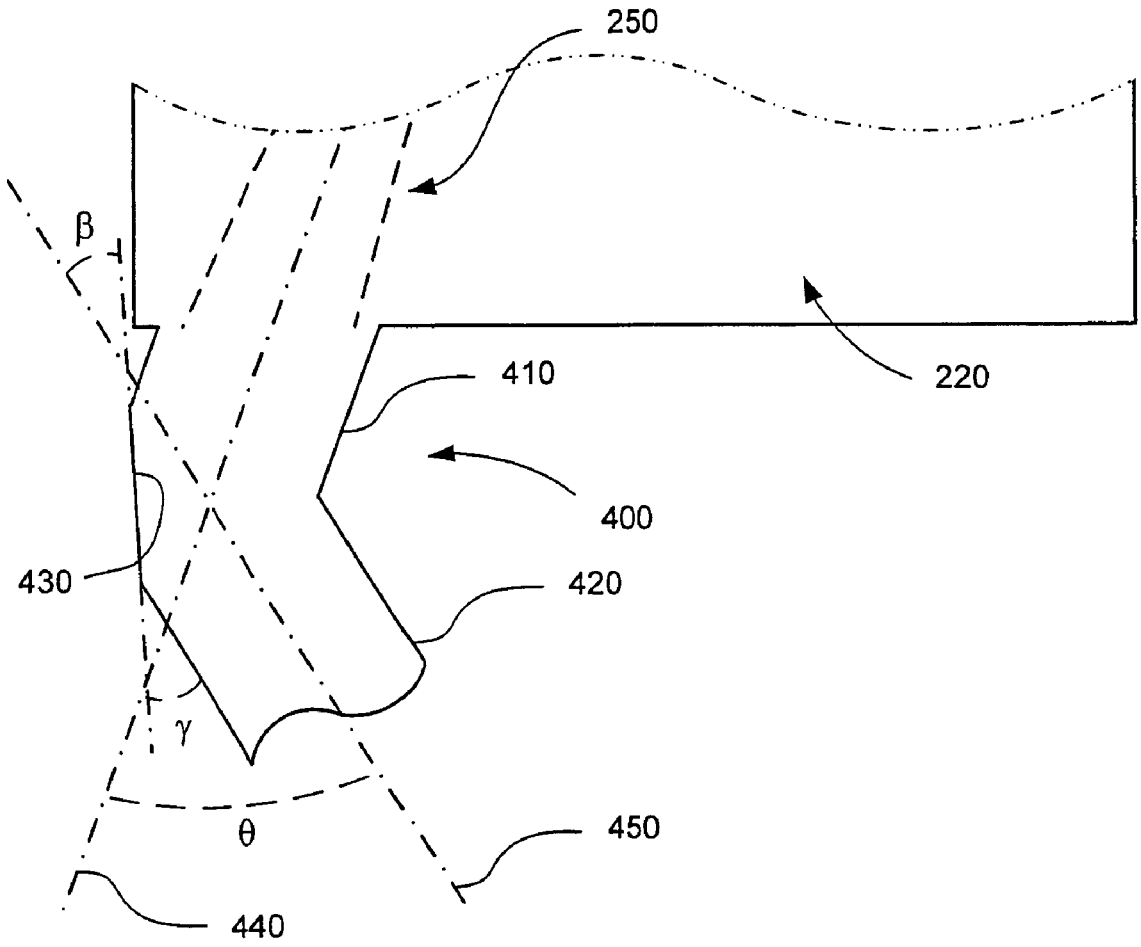
FIG. 4 shows an exhaust port according to another embodiment of the present invention.

FIG. 4 illustrates an alternative embodiment of an exhaust port 400. The exhaust port 400 includes a first segment 410, a second segment 420, and a deflecting surface 430. The first segment 410 defines a first axis 440, and the second segment defines a second axis 450. The deflecting surface 430 extends from the first segment 410 to the second segment 420, and in some embodiments, such as the embodiment shown in FIG. 4, the deflecting surface 430 extends from an interior surface of the first segment 410 to an interior surface of the second segment 420.

The embodiment shown in FIG. 4 can be implemented, for example, by joining two tubes at an angle to become the first and second segments 410 and 420. Next, a deflecting plate, having a surface that will become the deflecting surface 430, is attached to the two tubes. The two tubes, before being joined, can each be cut so that after being joined they form an L-shaped piece with a hole at the elbow where the deflecting plate will attach. Alternately, after the two tubes are joined, the elbow of the combined L-shaped piece is cut away to allow for the deflector plate to be attached.

Figure 5:
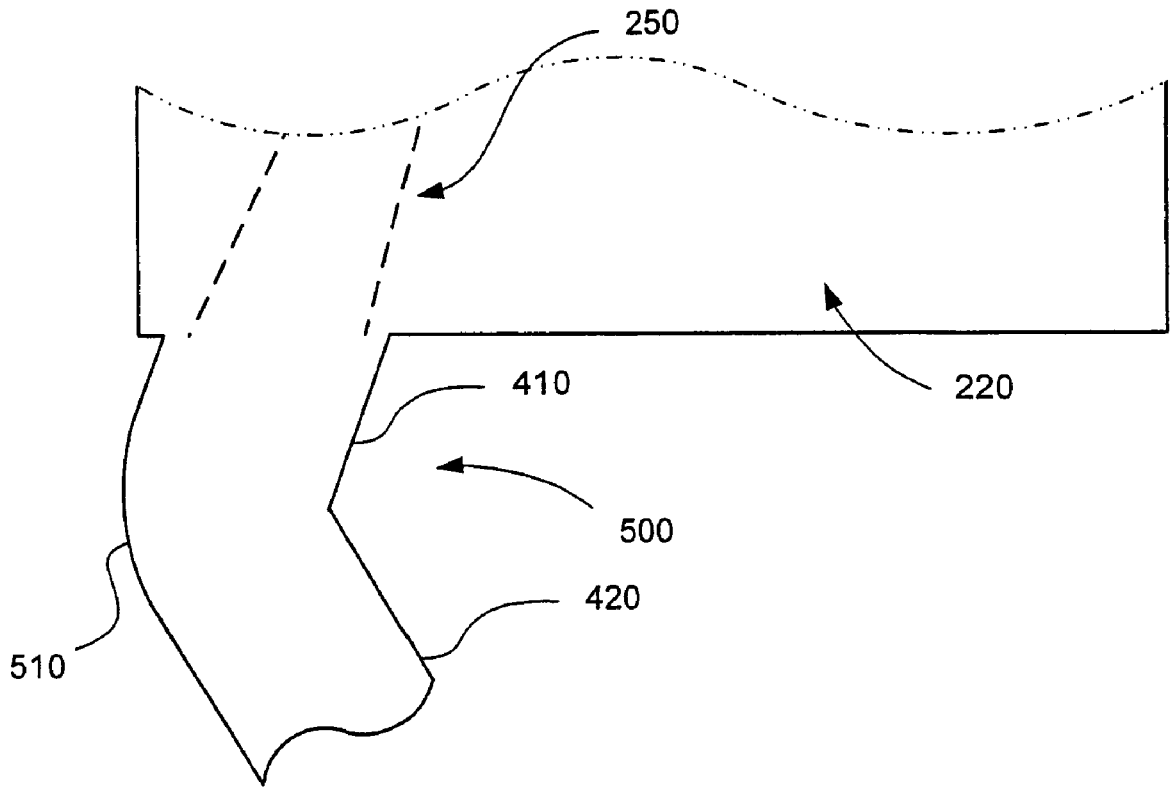
FIG. 5 shows another exhaust port according to another embodiment of the present invention.

The deflecting surface 430 serves to further deflect droplets from within the first segment 410 into the second segment 420 and is, therefore, angled with respect to both of the first and second segments 410 and 420. As shown in FIG. 4, the deflecting surface 430 forms an angle, β, with respect to the second axis 450, and an angle, γ, with the first axis 440. In some embodiments the deflecting surface 430 is angled such that the two angles β and γ are equal. For example, where θ is 90°, the deflecting surface 430 forms a 45° angle with both axes 440 and 450. As illustrated by FIG. 5, an exhaust port 500 of the present invention can comprise a deflecting surface 510 that is curved to better focus deflected droplets towards the second axis 450 of the second segment 420.

Another advantage of the deflecting surfaces 430 and 510 is that they reduce the diameter of the exhaust ports 400 and 500 in the region of the bend from the first segment 410 to the second segment 420. The diameter reduction creates a venturi effect in this region which accelerates the droplets through the bend.

In the foregoing specification, the invention is described with reference to specific embodiments thereof, but those skilled in the art will recognize that the invention is not limited thereto. Various features and aspects of the above-described invention may be used individually or jointly. Further, the invention can be utilized in any number of environments and applications beyond those described herein without departing from the broader spirit and scope of the specification. The specification and drawings are, accordingly, to be regarded as illustrative rather than restrictive. It will be recognized that the terms "comprising," "including," and "having," as used herein, are specifically intended to be read as open-ended terms of art.

What is claimed is:

1. An atmospheric pressure ionization source comprising:

a housing defining a chamber;

a spray probe configured to produce a spray cone along a spray axis within the chamber;

an ion exit orifice for transporting ions generated from the spray cone toward a mass analyzer; and an exhaust port disposed opposite to the spray probe on the housing and including a first segment disposed between a second segment and an opening through the housing to receive the spray cone, the first segment defining a first axis that is co-axial with the spray axis, and the second segment defining a second axis that is angled with respect to the first axis.

2. The atmospheric pressure ionization source of claim 1 wherein the spray axis defines an angle of less than 90° relative to an axis defined by an ion exit orifice of the housing.

3. The atmospheric pressure ionization source of claim 1 wherein the second axis is angled with respect to the first axis by an angle in the range of about 60° to 90°.

4. The atmospheric pressure ionization source of claim 1 wherein the opening is at least as wide as a width of the spray cone at the opening.

5. The atmospheric pressure ionization source of claim 1 wherein the exhaust port further includes a deflecting surface extending from the first segment to the second segment.

6. The atmospheric pressure ionization source of claim 5 wherein the deflecting surface is curved.

7. The atmospheric pressure ionization source of claim 1 wherein the exhaust port further includes a diameter reduction to create a venturi effect therein.

* * * * *